US009193367B2

(12) United States Patent
Hilleary

(10) Patent No.: US 9,193,367 B2
(45) Date of Patent: Nov. 24, 2015

(54) CROSSING PROXIMITY AND TRAIN-ON-APPROACH NOTIFICATION SYSTEM

(71) Applicant: Thomas N. Hilleary, Sunrise Beach, MO (US)

(72) Inventor: Thomas N. Hilleary, Sunrise Beach, MO (US)

(73) Assignee: THE ISLAND RADAR COMPANY, Olathe, KS (US)

( * ) Notice: Subject to any disclaimer, the term of this patent is extended or adjusted under 35 U.S.C. 154(b) by 92 days.

(21) Appl. No.: 14/049,705

(22) Filed: Oct. 9, 2013

(65) Prior Publication Data

US 2014/0166820 A1 Jun. 19, 2014

Related U.S. Application Data

(60) Provisional application No. 61/711,393, filed on Oct. 9, 2012.

(51) Int. Cl.

| | |
|---|---|
| ***B61L 29/02*** | (2006.01) |
| ***B61L 29/24*** | (2006.01) |
| *B61L 5/20* | (2006.01) |

(52) U.S. Cl.

CPC ..... *B61L 29/246* (2013.01); *B61L 5/206* (2013.01)

(58) Field of Classification Search

CPC ..... B61L 25/00; B61L 25/02; B61L 25/021; B61L 25/023; B61L 29/00; B61L 29/02; B61L 29/08; B61L 29/18; B61L 29/22; B61L 29/24

USPC ..... 246/108, 111–114 A, 117, 122 R–124, 246/473 R, 473.1, 477

See application file for complete search history.

(56) References Cited

U.S. PATENT DOCUMENTS

| | | | | |
|---|---|---|---|---|
| 5,554,982 | A * | 9/1996 | Shirkey et al. | 340/903 |
| 5,620,155 | A * | 4/1997 | Michalek | 246/121 |
| 5,699,986 | A * | 12/1997 | Welk | 246/125 |
| 2007/0139221 | A1 * | 6/2007 | Falvey | 340/902 |

* cited by examiner

*Primary Examiner* — R.J. McCarry, Jr.

(74) *Attorney, Agent, or Firm* — Armstrong Teasdale LLP

(57) ABSTRACT

A system includes a base station associated with a railroad crossing having a unique identifier and comprising at least one processor to wirelessly transmit a proximity alert, determine that a train is on approach, and wirelessly transmit a train-on-approach notification. The system further includes a receiver comprising at least one processor to wirelessly receive the proximity alert and the train-on-approach notification from the base station and to provide at least one of a visual and audible indication responsive to at least one of the proximity alert and the train-on-approach notification.

61 Claims, 10 Drawing Sheets

CROSSING PROXIMITY AND TRAIN-ON-APPROACH NOTIFICATION SYSTEM

RELATED APPLICATIONS

This application claims the benefit of priority to U.S. Provisional Application No. 61/711,393, filed Oct. 9, 2012, entitled "Crossing Proximity and Train-On-Approach Notification System," the entire contents of which are hereby incorporated herein by reference.

FIELD

The present systems and methods relate generally to a system and method for reminding and warning drivers about railroad crossings, and more particularly to a system and method associated with a base station to transmit a proximity alert and/or train-on-approach notification, and a receiver to receive the proximity alert and/or the train-on-approach notification and provide visual and/or audible information associated with the proximity alert and/or the train-on-approach notification.

BACKGROUND

In North America alone, there are more than 224,000 public and private at-grade railroad crossings. Of these railroad crossings, 137,699 or 61% are located on public roads. Of the railroad crossings on public roads, 51% comprise passive railroad crossings and 49% comprise active railroad crossings. Passive railroad crossings are non-electrified and denoted by fixed signage (e.g., crossbucks, stops signs, yield signs) or nothing at all. Active railroad crossings are electrified and include fixed signage in addition to warning systems with flashing lights and gates to more effectively warn vehicles of the presence of trains on approach.

The United States Department of Transportation (USDOT) has studied safety effectiveness of railroad crossing warning systems and found that upgrading a passive railroad crossing to an active railroad crossing with a flasher warning system increased warning system effectiveness by 70% while upgrading a passive railroad crossing to an active railroad crossing with gates and flashing lights increased warning system effectiveness by 83%. However, the majority of passive railroad crossings in the United States remain so out of economic necessity. Passive railroad crossings are expensive to convert to active railroad crossings. A passive railroad crossing can be converted to an active railroad crossing by adding more than $150,000 of equipment, adding track circuits to detect trains on approach, and establishing commercial power at the crossing site.

Between 2002 and 2012, there were 28,125 accidents at railroad crossings in the United States resulting in 14,176 injuries and/or fatalities. Various causes were cited by the Federal Railroad Administration (FRA) statistics on reported and investigated accidents for this ten-year period, but most accidents were related to driver inattentiveness. According to the FRA statistics, 0.9% of accidents were caused by driver impairment, 40.0% of accidents were caused by driver inattentiveness, 11.3% of accidents were caused by driver misjudgment, 23.1% of accidents were caused by driver violation, 0.5% of accidents were caused by driver unawareness or environmental factors, 0.7% of accidents were caused by a driver being unable to stop (e.g., weather related), 0.1% of accidents were caused by crossing signal malfunction, 10.9% of accidents were caused by deliberate disregard for a crossing signal, and 12.5% of accidents were a result of other causes.

Causes for driver inattentiveness can include distractions associated with cellular telephone or in-vehicle entertainment system use and other activities that take a driver's attention away from the road long enough for the driver to miss a sign at a railroad crossing or an active signal that warns of an approaching train. In addition, some drivers frequently travel the same route and can become desensitized to the presence of a railroad crossing, especially a passive railroad crossing located in a rural or lightly traveled road only equipped with crossbuck signs.

Over the past fifteen years there have been a variety of approaches introduced and tested to address safety at railroad crossings. One approach utilizes a transceiver on a train that communicates directly to radio receivers mounted in vehicles or indirectly through trackside transceivers. In another approach, a K-band radar signal is sent from a trackside transceiver to a specially modified radar detector in a vehicle. In another approach, a vehicle-borne receiver attempts to recognize a train horn acoustic signature to trigger a driver alert.

However, previous approaches have not been successful. Previous approaches have failed for a number of reasons including (1) cost, complexity, and railroad risk of train mounted transceivers, (2) cost and complexity of integrating a receiver into a vehicle either as an aftermarket dash-mounted device or as an original equipment manufacturer (OEM) in-dash feature, (3) unsatisfactory false triggering and missed event performance, and (4) inadequacy for use at non-electrified passive crossings.

SUMMARY

Briefly described, and according to one embodiment, aspects of the present disclosure generally relate to a system and method of a system and a method for reminding drivers of a proximate railroad crossing and warning drivers when a train is on approach to a proximate railroad crossing. The system includes a base station to transmit at least one of a proximity alert and a train-on-approach notification and a receiver to receive the at least one of the proximity alert and the train-on-approach notification from the base station.

According to one embodiment, a system includes a base station associated with a railroad crossing and comprising at least one processor to wirelessly transmit a proximity alert, determine that a train is on approach, and wirelessly transmit a train-on-approach notification. The system further includes a vehicle receiver comprising at least one processor to wirelessly receive the proximity alert and the train-on-approach notification from the base station and to provide at least one of a visual and audible indication responsive to at least one of the proximity alert and the train-on-approach notification.

According to an additional embodiment, a system comprises a memory and at least one processor to perform low power radio listening to receive a proximity alert encoded in a first message, wirelessly receive the proximity alert encoded in the first message from a base station, wirelessly receive a train-on-approach notification encoded in a second message from the base station, display information responsive to the proximity alert and the train-on-approach notification, and provide audible information responsive to the proximity alert and the train-on-approach notification.

According to a further embodiment, a system includes a memory and at least one processor to receive electrical power from a power supply deriving power from at least one member of a group consisting of a battery, a solar cell, and a commercial power station, wirelessly transmit a proximity alert in the 2.4 GHz radio spectrum using a transceiver, receive a train-on-approach message from at least one member of a group consisting of a railroad crossing relay, a positive train control (PTC) database, a railroad dispatch center, and a PTC transmitter onboard a train-on-approach, and wirelessly transmit a train-on-approach notification in the 2.4 GHz radio spectrum responsive to the train-on-approach message.

According to another embodiment, a base station detects a train on approach to a railroad crossing without using track circuits. The base station is informed of a proximate train location via a low power receive-only PTC radio or a full PTC transceiver located in the base station. The base station is informed of a train-on-approach to the base station by at least one of an approaching train sending a PTC transmission to the base station and a PTC database with realtime awareness of a train approaching the base station and sending a PTC transmission to the base station. The PTC database is connected to the base station via a cellular network, a fiber network, or any other secure network connection.

According to an even further embodiment, a system includes a base station transceiver and a receiver. The base station transceiver includes at least one processor to transmit at least one of a proximity alert and a train-on-approach notification. The receiver includes at least one processor to receive the at least one of the proximity alert and the train-on-approach notification and to generate at least one member of a group consisting of a proximity alert and a train-on-approach notification.

According to an additional embodiment, a method includes entering, by at least one processor, a quiescent state, low power listening, by the at least one processor, for an alert from a base station, receiving, by the at least one processor, a proximity alert from the base station, entering, by the at least one processor, a proximity state responsive to the proximity alert from the base station, and providing, by the at least one processor, at least one of visual and audible information responsive to the proximity state. The method further includes receiving, by the at least one processor, a train-on-approach notification from the base station, entering, by the at least one processor, a train-on-approach state responsive to the train-on-approach notification from the base station, and providing, by the at least one processor, at least one of visual and audible information responsive to the train-on-approach state.

According to an even further embodiment, a method includes receiving, by at least one processor in a receiver, a level of acceleration, providing, by the at least one processor, electrical power to a power supply responsive to the level of acceleration, entering, by the at least one processor, a quiescent state, and low power radio listening, by the at least one processor, for a proximity alert from a base station. The method further includes receiving, by the at least one processor, a proximity alert from the base station, entering, by the at least one processor, a proximity state responsive to the proximity alert from the base station, and providing, by the at least one processor, at least one of visual and audible information responsive to the proximity state. The method further includes receiving, by the at least one processor, acceleration that is less than the level of acceleration for a predetermined period of time and sending, by the at least one processor, a notification to discontinue providing the electrical power by the power supply responsive to the acceleration that is less than the level of acceleration for the predetermined period of time.

According to another embodiment, a method includes wirelessly transmitting, by at least one first processor, a proximity alert, determining that a train is on approach, and wirelessly transmitting a train-on-approach notification and wirelessly receiving, by at least one second processor, the proximity alert and the train-on-approach notification and providing at least one of a visual and audible indication responsive to at least one of the proximity alert and the train-on-approach notification.

These and other aspects, features, and benefits of the present disclosure will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1A:
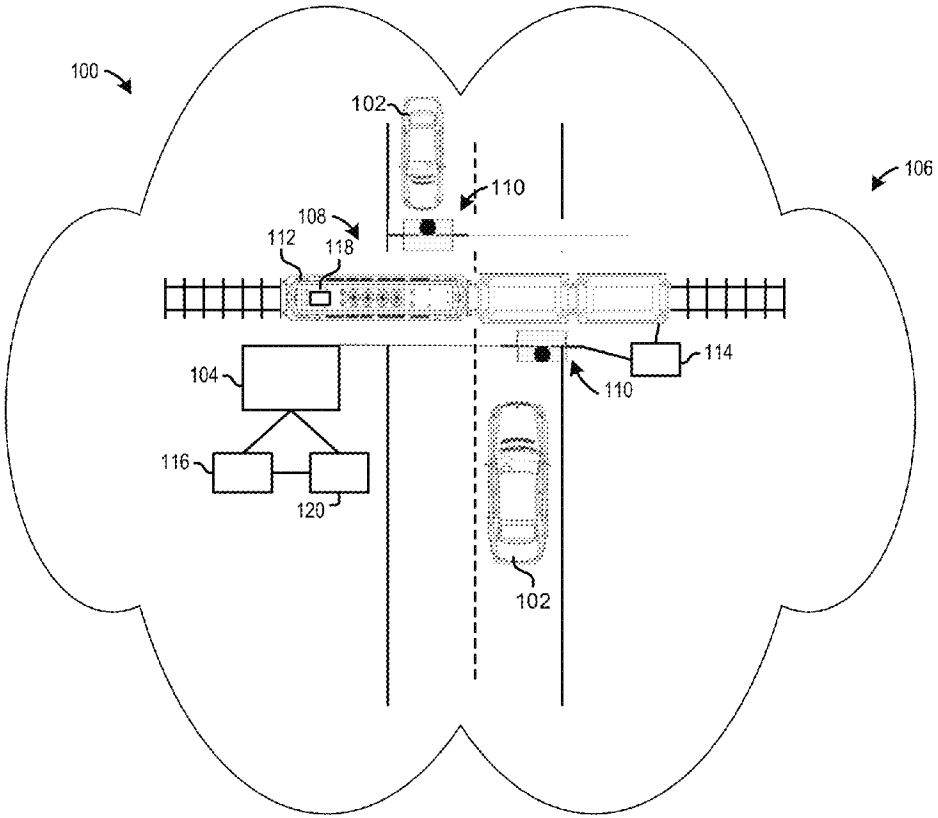
FIG. 1A illustrates a block diagram of a crossing proximity and train-on-approach notification system, according to an example embodiment.

For the purpose of promoting an understanding of the principles of the present disclosure, reference will now be made to the embodiments illustrated in the drawings, and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates.

The embodiments disclosed herein provide a reliable and low-cost system and method for reminding drivers of a proximate railroad crossing and warning drivers when a train is on approach to a proximate railroad crossing. The systems and methods disclosed herein remind a driver of a vehicle outfitted with a receiver that a crossing, e.g. a railroad crossing, is within range of the receiver. The systems and methods provide a first alert when a passenger vehicle is approaching a railroad crossing and, alternately, an additional heightened second alert when a train is on approach to the crossing. The embodiments provide a means of improving safety at passive railroad crossings and active railroad crossings by establishing an active warning mechanism within or onboard a vehicle that receives a broadcast from a base station located at a railroad crossing.

A low power wireless crossing proximity message is continually broadcast by trackside equipment associated with a particular railroad crossing such as a base station to notify receivers that come within range of the base station. The message has encoded information including a proximity alert and/or a train-on-approach notification. According to an example embodiment, the base station continually broadcasts or periodically broadcasts one of two messages including (1) a proximity alert and (2) a train-on-approach notification. The base station broadcasts a proximity alert when a train is not on approach to an associated railroad crossing and transitions to broadcasting a train-on-approach notification when a train is on approach to an associated railroad crossing. For example, a base station may be prompted to transition from a proximity alert to a train-on-approach notification by a crossing relay (XR) associated with a railroad crossing, a real time Positive Train Control (PTC) database and railroad dispatch center that maintains constant awareness of train location and speed (and other current asset information), and/or a train outfitted with PTC equipment approaching the railroad crossing. Therefore, the method and system provides a practical railroad crossing safety solution for both electrified active crossings having at least one of flashing lights and automatic gates and non-electrified passive crossings where no track circuit equipment for train detection equipment is available.

The receiver can be mounted on motorized vehicles, mounted on non-motorized vehicles, and carried by pedestrians. As an example, the receiver can be located within a vehicle, e.g. adhered to a windshield of the vehicle, mounted in a dashboard, or within a rearview mirror assembly. By adhering the receiver to a windshield, the receiver is located in an optimal position to power a solar cell and receive signals from a trackside transmitter in the base station. This is also an optimal position for the receiver because a driver of the vehicle will be able to view the receiver while operating the vehicle and maintaining a focus on the road.

FIG. 1A illustrates a block diagram of a crossing proximity and train-on approach notification system 100 according to an example embodiment. The system includes at least one receiver 102 and at least one base station 104 communicating over a communications network 106. According to exemplary embodiments, the system 100 can be used to improve safety at and awareness of active railroad crossings and passive railroad crossings.

The railroad crossing 108 shown in FIG. 1A is an active railroad crossing that is electrified. The pictured railroad crossing 108 includes an automatic crossing gate 110 that is activated by an approaching train 112. The system 100 can be used to improve safety at and awareness of this active railroad crossing.

When the receiver 102 is powered on, the receiver 102 can first perform a battery and HealthCheck procedure. The HealthCheck procedure is optional and involves at least determining a battery level of the receiver 102. If the HealthCheck procedure is successful or if no HealthCheck is performed, the receiver will begin low power listening. In other words, the receiver 102 will periodically turn on a radio and poll a radio spectrum for any activity from a nearby base station. While in the process of low power listening, the receiver 102 will wait to receive a proximity alert with or without a train-on-approach notification and will periodically indicate that the receiver 102 is powered on. The receiver 102 can indicate that it is powered on and low power listening by periodically illuminating a light emitting diode (LED).

When the receiver 102 is within radio range of a railroad crossing outfitted with a base station 104 broadcasting a proximity alert, the receiver 102 will receive the proximity alert and provide a visual alert and/or an audible alert to remind and inform a driver of a vehicle or another person outfitted with the receiver 102 that there is a railroad crossing nearby. This visual and/or audible proximity alert supplements roadside signage and warning systems and can be provided to a driver of the vehicle before the driver approaches roadside signage and warning systems. If there is not a train on approach and/or the railroad crossing has not been activated, the receiver 102 will provide only a proximity alert. As an example, when a receiver 102 receives a proximity alert from a base station 104, the receiver 102 displays a railroad crossing sign and/or produces an audible signal or message.

If the receiver 102 is within radio range of a railroad crossing outfitted with a base station 104 and the base station 104 has been notified that a train is on approach, the base station will broadcast a train-on-approach notification and the receiver 102 will receive the train-on-approach notification. The receiver 102 will provide a visual alert and/or an audible alert to remind and inform a driver of a vehicle or another person outfitted with the receiver 102 that there is a railroad crossing nearby with a train on approach. As an example, when a receiver 102 receives a train-on-approach notification from a base station 104, the receiver 102 displays a flashing railroad crossing sign and/or produces an audible signal or message.

If the receiver 102 is not within the vicinity of a railroad crossing outfitted with a base station 104, the receiver 102 will continue to periodically poll for radio activity from a base station 104. While periodically polling for radio activity, the receiver 102 may periodically illuminate a LED, e.g. a Health LED, to indicate that the receiver is in operation.

The messages broadcast from a base station 104, e.g., a proximity alert and a train-on-approach notification, can be encoded and optionally include internal data validation (e.g., a checksum) to prevent false triggering of the receiver 102. A checksum is produced by a checksum algorithm that is applied to data. As an example, a checksum algorithm can be applied to a message to be broadcast from a base station to produce a first checksum. A base station 104 sends both a message and a first checksum to a receiver 102. When a message is received by a receiver 102, the receiver 102 can apply a checksum algorithm to the message to produce a second checksum. The receiver 102 can then compare the first checksum and the second checksum before producing a proximity alert and/or a train-on-approach notification.

The base station 104 can be identified by a unique identifier associated with a specific railroad crossing, e.g., 1234, and includes a radio module attached to an antenna that continually broadcasts one of two messages including (1) a proximity alert and (2) a train-on-approach notification. The message can be broadcast in the 2.4 GHz band or another frequency such as 5.9 GHz reserved for Dedicated Short Range Communications (DSRC) use at a sufficient power to be received from 0-0.1 miles from the base station 104. Optionally, the message may be broadcast at another frequency with a sufficient power to be received up to 0.5 or even two miles from the base station 104. A receiver 102 will continually listen for a message from a base station 104. As an example, the receiver 102 may "listen" for a broadcast from a base station for 50 microseconds (ms) every half second or at other increments or time frames. This conservative duty cycle allows the receiver 102 to conserve battery power.

The base station 104 is informed of a train on approach to an associated railroad crossing in a plurality of ways, and a train-on-approach message can be sent to a specific railroad crossing using the particular identifier associated with the specific railroad crossing. For active railroad crossings (e.g., crossings outfitted with track circuit train detection, flashing warning lamps, and gates) the base station 104 receives a notification from a primary electrical crossing relay (XR) 114 that is used to activate the track circuit. The crossing relay is used to inform the base station 104 that a train is approaching.

As a second option, the base station 104 receives a communication from a positive train control (PTC) database 116 (via wired or wireless communication) when a train is on approach to an associated railroad crossing. The PTC database 116 that maintains constant awareness of all trains associated with a railroad system and can determine when a train is on approach to the associated railroad crossing. The PTC database 116 executes a procedure, e.g., a query, to correlate train location with a particular railroad crossing associated with the base station 104. The base station 104 receives the communication from the PTC database 116 via a fixed network or through a wireless connection. The PTC database 116 includes a processor, memory, computer executable instructions, and data to execute queries and transmit communications. In addition, the PTC database 116 further includes at least one communications interface to transmit and receive communications, messages, and/or signals.

As a third option, the base station 104 receives a message broadcast from an approaching train using PTC. Particular locomotives and other railroad cars associated with a train 112 are equipped with PTC equipment 118 including onboard computers, route maps, and wireless communication capabilities that allow the train 112 to be in constant communication with wayside equipment along a railroad. A train 112 equipped with the PTC equipment 118 constantly knows its location relative to all railroad assets, including railroad crossings and base stations. The PTC equipment 118 includes at least one processor, memory, computer readable executable instructions, data, and at least one communications interface to transmit and receive communications, messages, and/or signals. The PTC equipment 118 on a locomotive or another railroad car associated with a train approaching the base station 104 broadcasts a PTC message received by the base station 104 that causes the base station to switch from broadcasting a proximity alert to a train-on-approach notification.

As a fourth option, the base station 104 receives a message broadcast from a railroad dispatch center 120 in communication from a PTC database. According to an example embodiment, a PTC equipped train communicates its location to the railroad dispatch center 120. Using the location of the train, the PTC database 116 can use a publish-subscribe schema to send a message to the base station 104 by correlating the train location with a geolocation of a railroad crossing. The railroad dispatch center 120 sends a message via a wireline and/or wireless network to the base station 104. The railroad dispatch center 120 includes at least one processor to process data and send/receive communications, memory, computer executable instructions, and a communications interface to transmit and receive communications, messages, and/or signals.

According to an example embodiment, the communications network 106 is an ultra low power mesh network operating according to 801.15.4 networking standards. A mesh network is a type of network where each node receives data and relays the data to other nodes in the network, e.g. a first receiver to a second receiver. The network 106 can be a wireless network operating at 2.4 GHz, 5.9 GHz, or another appropriate frequency. The network 106 provides a wireless personal area network (WPAN) and may serve as a mobile ad hoc network (MANET). According to a further embodiment, a receiver 102 propagates a proximity alert and/or a train-on-approach notification to another receiver 102 within the network 106. In other words, the receiver 102 repeats or relays the proximity alert and/or the train-on-approach notification to another receiver that is within range of the receiver 102. The proximity alert and/or the train-on-approach notification can be propagated a configurable number of hops, e.g. from the base station 104 to a first receiver to a second receiver to a third receiver.

Figure 1B:
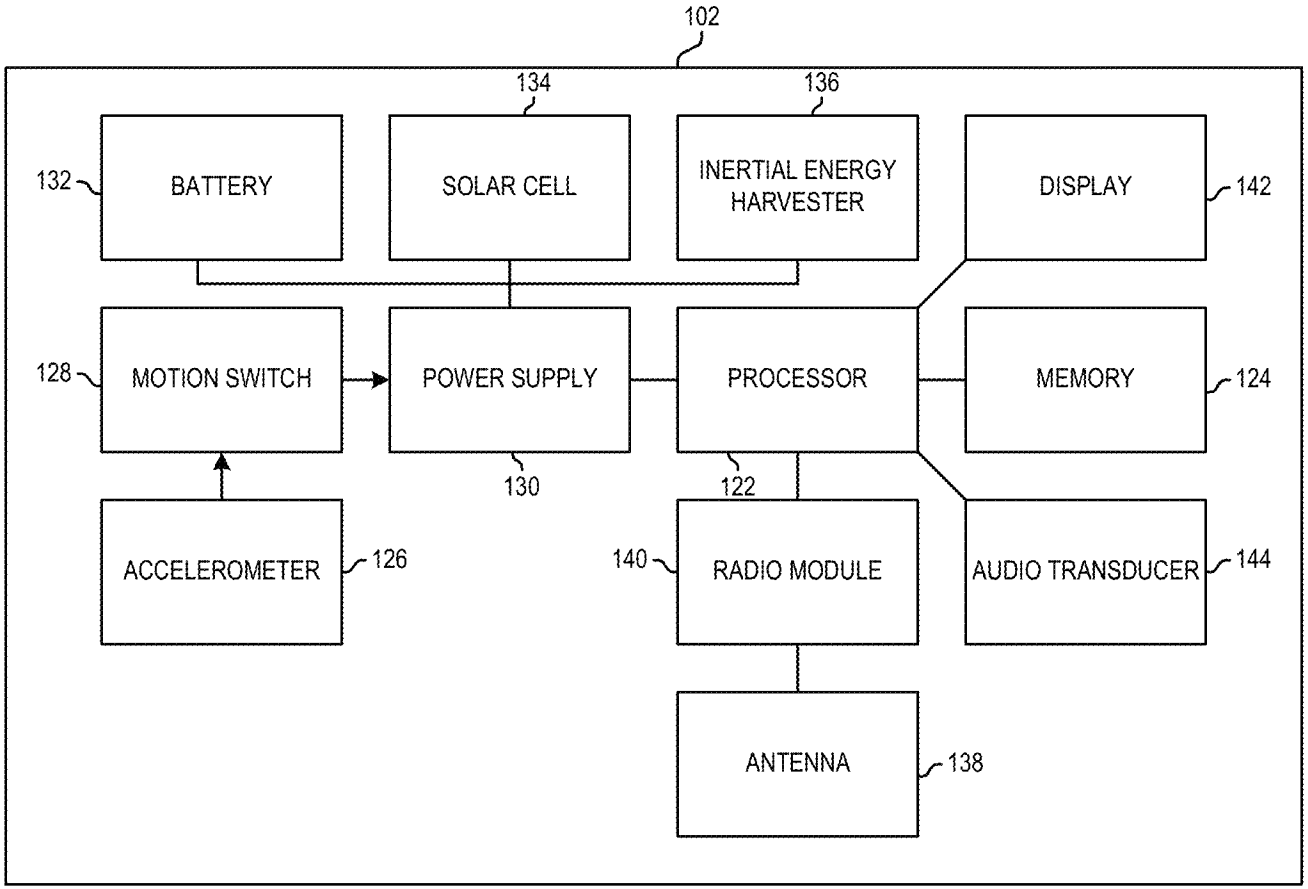
FIG. 1B illustrates a block diagram of a receiver of a crossing proximity and train-on-approach notification system, according to an example embodiment.

FIG. 1B illustrates a block diagram of a receiver 102 according to an example embodiment. The receiver 102 receives wireless communications and signals from the base station 104. The receiver 102 includes at least one processor 122 to process data and memory 124 to store data. The processor 122 processes communications, builds communications, retrieves data from its memory, and stores data to its memory. The memory 124 may include volatile and/or nonvolatile memory, e.g., a computer-readable storage medium such as a cache, random access memory (RAM), read only memory (ROM), flash memory, or other memory to store data and/or computer-readable executable instructions. In addition, the receiver 102 further includes at least one communications interface to transmit and receive communications, messages, and/or signals.

As an example, the receiver 102 may be located in a motor vehicle, e.g., an automobile, and adhered to a windshield of the vehicle. The receiver 102 automatically powers on when the vehicle begins to move and automatically powers off after a predetermined time period when the vehicle is not moving, e.g. five minutes. An accelerometer 126 is activated when the vehicle accelerates and is in motion. According to an exemplary embodiment, the accelerometer 126 may be a three-axis accelerometer that detects acceleration. Once motion is detected by the accelerometer 126, the accelerometer notifies a motion switch 128 to begin operation of the receiver 102. The motion switch 128 sends a signal to the power supply 130 to power on the receiver 102. The power supply 130 derives power from sources including a battery 132, and/or a solar cell 134, and/or an inertial energy harvester 136 and provides power to the processor 122.

The battery 132 may be a coin cell battery capable of powering the receiver 102 for approximately a few years without being replaced. An optional solar cell 134 includes at least one photovoltaic panel capable of converting solar energy into electrical energy stored in the solar cell 134 and/or the power supply 130. An optional inertial energy harvester 136 derives energy from vehicle vibration and other motion. The motion is converted into electrical energy and stored in the inertial energy harvester 136 and/or power supply 130.

The processor 122 processes wireless communications and signals received by an antenna 138 and a radio module 140. The processor 122 interprets incoming wireless communications and signals, stores the communications and signals in processor memory and/or memory 124, stores output in processor memory and/or memory 124, and sends output to the display 142 and/or the audio transducer 144. The audio transducer 144 is a piezo-electric transducer or any other appropriate audio producing device. The display 142 is a low power, high conspicuity display that is viewable in various lighting situations and viewing angles, e.g. an organic light-emitting diode (OLED) display.

Figure 1C:
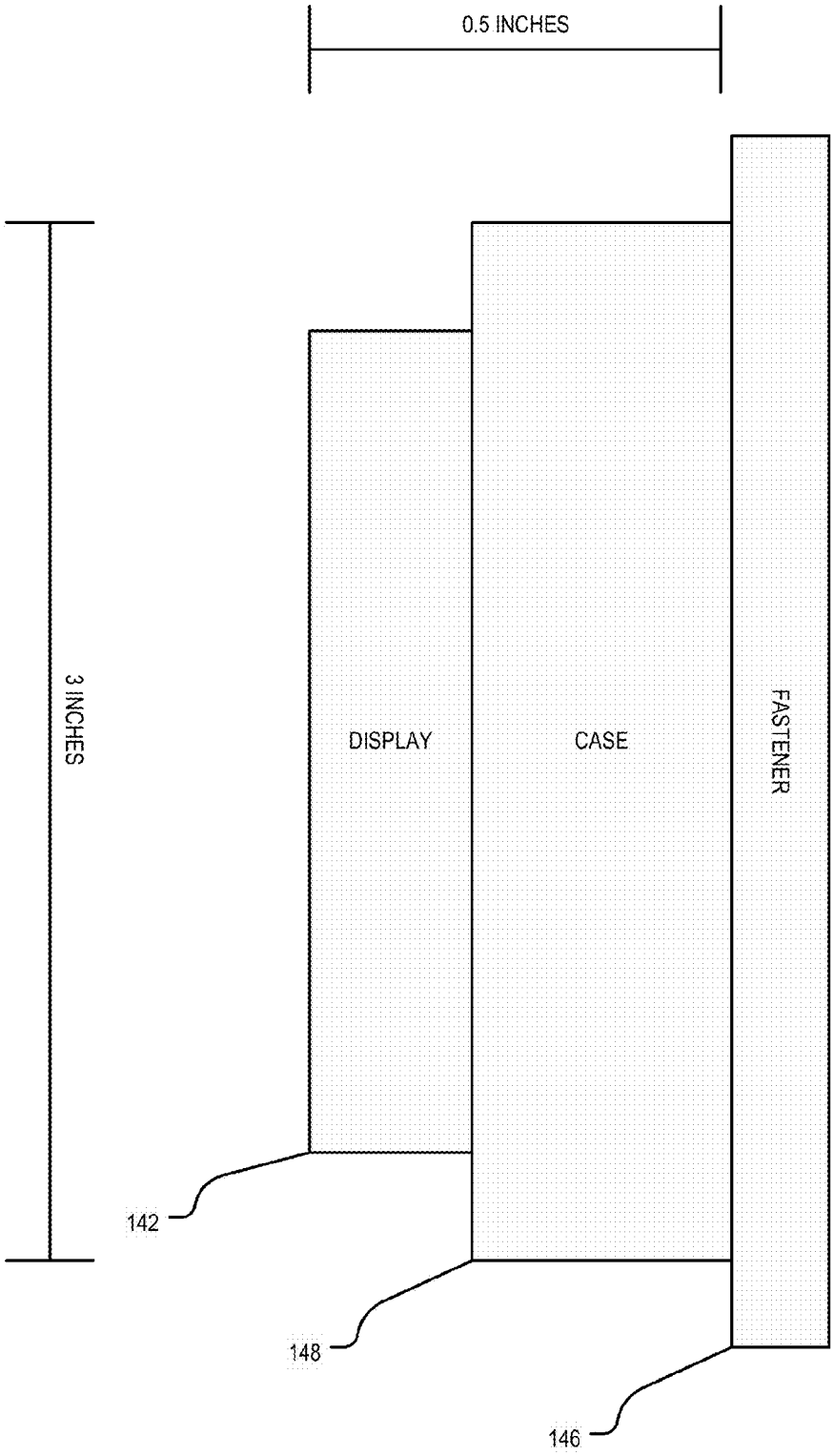
FIG. 1C illustrates a side view of a receiver of a crossing proximity and train-on-approach notification system, according to an example embodiment.

FIG. 1C shows a side view of an exemplary receiver 102. As shown in FIG. 1C, the display 142 is mounted on top of other components of the receiver, e.g., the power supply 130, etc. The receiver 102 includes a fastener 146 used to attach or mount the receiver to a surface, such as a windshield of a vehicle. The fastener 146 can be double sided tape, VELCRO®, a keychain, a nut and bolt, a ziptie, or any other appropriate device. In addition, the receiver can include a module 148 to store and protect the components of the receiver 102, e.g. a plastic or metallic shell. According to an example embodiment, the receiver 102 is approximately three inches long, three inches wide, and 0.5 inches deep.

Figure 1D:
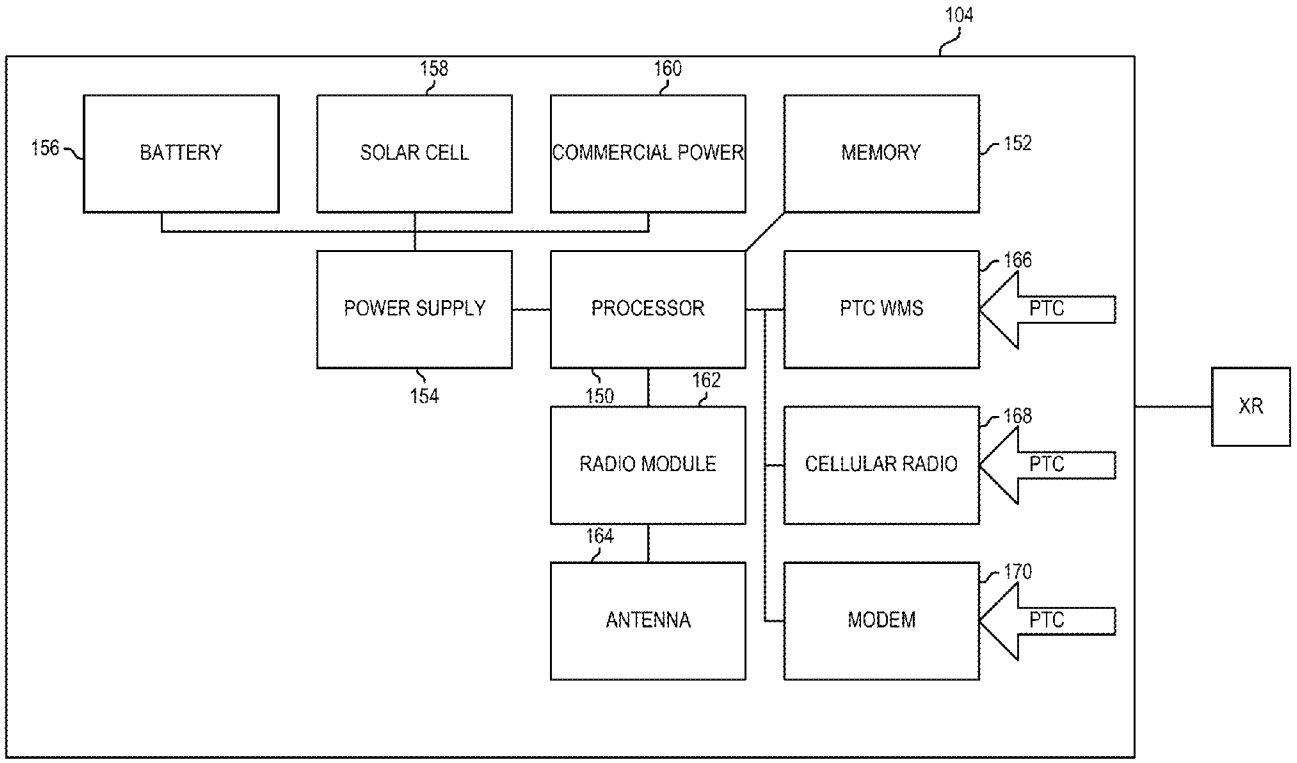
FIG. 1D illustrates a block diagram of a base station of a crossing proximity and train-on-approach notification system, according to an example embodiment.

FIG. 1D illustrates a block diagram of a base station 104 according to an example embodiment. The base station 104 acts as a transmitter to continually broadcast a message to notify a receiver 102 within range of a railroad crossing. The base station 104 broadcasts a message comprising one of a proximity alert and a train-on-approach notification. Thus, the base station 104 is capable of indicating that an associated railroad crossing is active and/or that there is a train-on-approach. In some cases, the base station 104 transmits both a proximity alert and a train-on-approach notification, which are received by the receiver 102 and processed as discussed above by the receiver 102 to generate both a reminder/alert and notification. The base station 104 also can act as a transceiver to optionally receive wireless and wireline communications and signals, such as mesh networking communications and other communications.

As an example, the base station 104 shown in FIG. 1D may be located at a railroad crossing. The base station includes at least one processor 150 to process data and memory 152 to store data. The processor 150 processes communications, builds communications, retrieves data from its memory, and stores data to its memory. The memory 152 may include volatile and/or non-volatile memory, e.g., a computer-readable storage medium such as cache, RAM, ROM, flash memory, or other memory to store data and/or computer readable executable instructions. In addition, the base station 104 further includes at least one communications interface to transmit and receive communications, messages, and/or signals. According to an example embodiment, the processor 150 processes communications and data and transmits or broadcasts a proximity alert and/or a train-on-approach notification. The processor 150 also optionally can activate railroad crossing gates 110 and/or lights associated with a railroad crossing 108.

The base station 104 includes a power supply 154 that powers the base station 104. The power supply 154 conditions and manages available power sources to provide power to the base station 104. The power supply 154 may derive power from at least one of a battery 156, a solar cell 158, and commercial power 160. The battery 156 can be used by the base station 104 as a backup power source in the event of a power outage affecting the commercial power 160. The solar cell 158 includes at least one photovoltaic panel capable of converting solar energy into electrical power and storing the electrical power in the solar cell 158 and/or the power supply 154. The base station 104 broadcasts messages from the radio module 162 via an antenna 164. The radio module 162 may be a 2.4 GHz or other frequency radio module, and the antenna 164 may be an omni-directional or other antenna.

The base station 104 may receive a message that a train is on approach to an associated railroad crossing, and the base station 104 will alter its broadcasted proximity alert to a train-on-approach notification. The base station 104 may be informed that the train is on approach via a crossing relay signal from active crossing equipment 114, a train on approach signal sent from a real-time PTC database source 114 or a centralized railroad dispatch center 120, and/or a PTC signal from PTC equipment 118 on an approaching locomotive. The base station 104 receives the train-on-approach message using at least one of a PTC wayside message server (WMS) and radio 166, a cellular radio 168, and a modem 170. According to an example embodiment, the PTC WMS 166 can be a transceiver or a receive only 220 MHz PTC radio operating in a single frequency band near 220 MHz or another frequency, and the modem 170 is a wireless and/or wired network modem. Each of the PTC WMS 166, cellular radio 168, and modem 170 receives the message that a train is on approach from a device associated with a PTC database 116 and/or from a train approaching the base station 104.

Figure 1E:
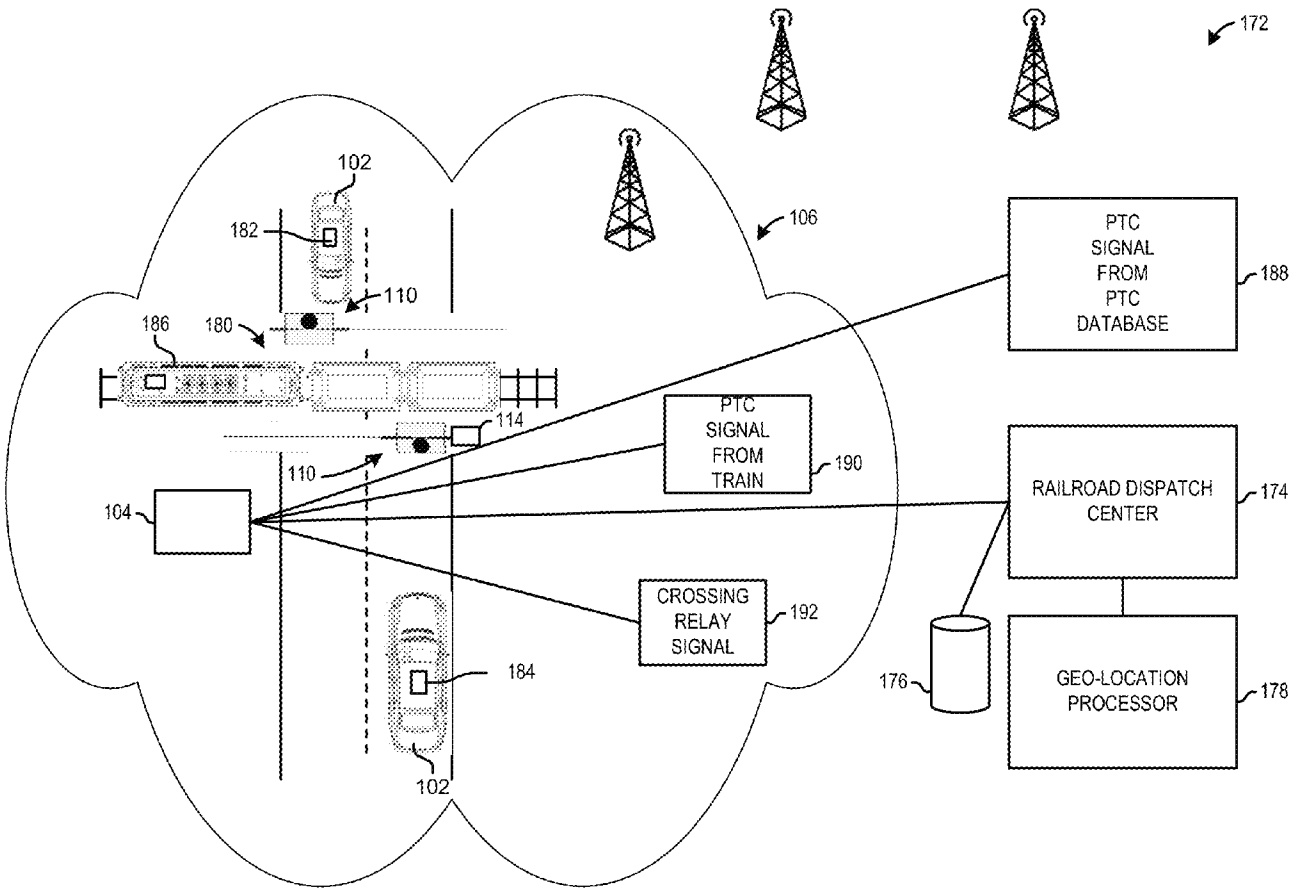
FIG. 1E illustrates an additional block diagram of a crossing proximity and train-on-approach notification system showing exemplary base station notification methods, according to an example embodiment.

FIG. 1E illustrates an additional block diagram of a crossing proximity and train-on approach notification system 100 according to an example embodiment. FIG. 1E shows a PTC network 172 that is connected to the network 106.

A PTC network 172 provides constant train location to an off-train centralized railroad dispatch center 174. The PTC network 172 comprises at least one PTC database 176 that stores and maintains awareness of train location(s). The PTC database 176 can be used to trigger and transmit a train-on-approach notification to a base station 104.

The PTC network 172 comprises at least one processor to process data and incoming messages, memory to store data about railroad crossings and associated base stations, a railway network, railway communications, railway protocols, railway systems, and other data. The PTC database 176 also includes a receiver to receive incoming messages via a wireless network and/or a wireline network. The wireless and/or wireline network is used to receive and transmit communications and messages between devices within the PTC network 172 and outside of PTC network. The PTC database 176 further includes at least one communications interface to transmit and receive communications, messages, and/or signals.

The railroad dispatch center 174 communicates with a geo-location processor 178 that subscribes to database messages originating from trains and determines when trains are sufficiently close to a railroad crossing. As an example, a train-on-approach to a railroad crossing can determine its current position using a global positioning system (GPS) outfitted on the train, and send its current position (e.g., current latitude and current longitude) to the geo-location processor 178. The train-on-approach to the railroad crossing also sends its current speed to the geo-location processor 178. The geo-location processor 178 compares the current position of the train to a location of the railroad crossing and, using the current speed of the train-on-approach, determines a time it will take for the train-on-approach to arrive at the railroad crossing.

The railroad crossing 180 shown in FIG. 1E is can be either an active crossing or a passive crossing. As shown in FIG. 1E, two vehicles 182, 184 outfitted with a receiver 102 are approaching a railroad crossing that is equipped with a base station 104. As the vehicles approach the railroad crossing and are within range of network 106, the receiver 102 will receive a proximity alert from the base station and provide a proximity alert to notify a driver of the vehicles 182, 184 that they are approaching a railroad crossing 180. If a train 186 is on approach or currently in the railroad crossing, the base station 104 will broadcast a train-on-approach notification. The base station 104 is notified of the presence of a train by at least one of a PTC database 176 sending a PTC signal 188, a railroad dispatch center 174 sending a PTC signal, a train 186 sending a PTC signal 190, and a crossing relay signal 192.

Figure 2A:
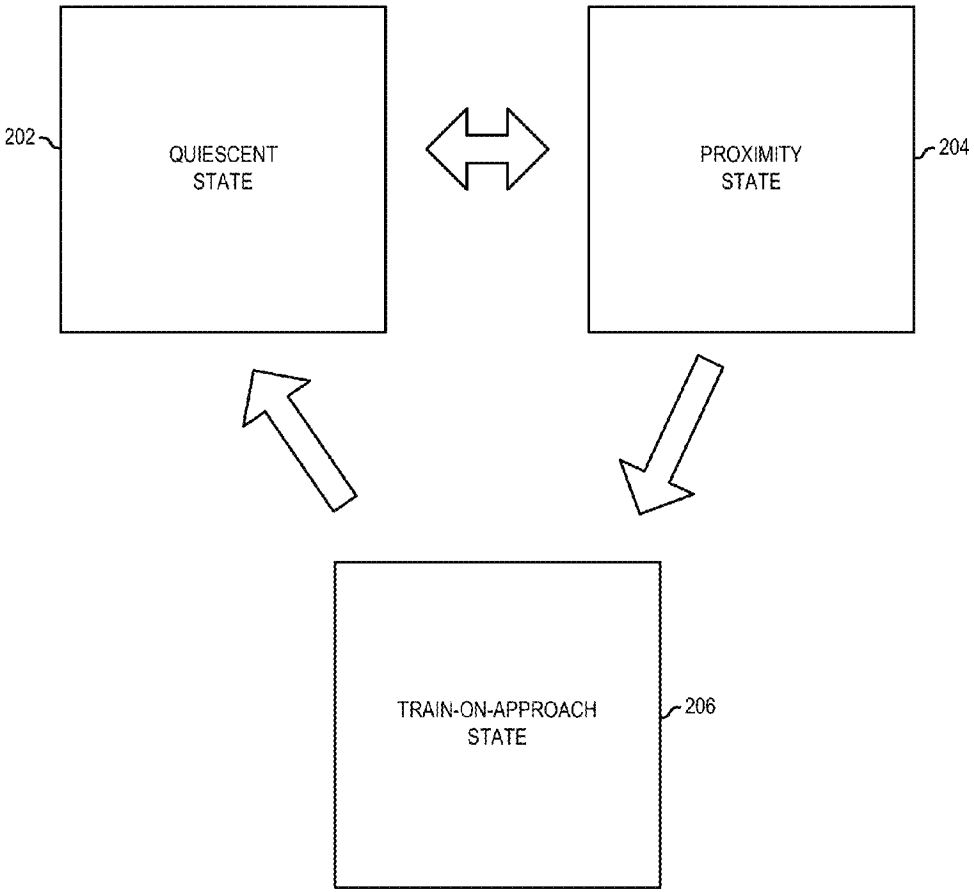
FIGS. 2A and 2B illustrate state diagrams of a crossing proximity and train-on-approach notification system, according to an example embodiment.

Now referring to FIG. 2A, a state diagram of a proximity alert and train-on-approach notification system 100 is shown. According to an example embodiment, when the receiver 102 is initially powered on, e.g., when a vehicle begins to move and activate the accelerometer 126, the receiver will perform a HealthCheck and will enter a quiescent state 202. While in the quiescent state 202, the receiver 102 will periodically indicate that it is powered on and that it is actively functioning. The receiver can indicate 102 that it is powered on and actively functioning by periodically flashing an LED and/or providing an audible tone. The receiver 102 will continually engage in low power listening to receive a broadcast from a nearby base station 104.

If the receiver 102 receives a proximity alert from a nearby base station 104, the receiver will enter a proximity state 204. If there is not a train-on-approach, then once the vehicle moves out of range of the base station 104, the receiver 102 will transition back to the quiescent state 202. However, if there is a train-on-approach while the vehicle is in range of the base station 104, the base station 104 will notify the receiver 102 that there is a train on approach, and the receiver will transition to the train-on-approach state 206. Once the vehicle moves out of range of the base station 104, the receiver will transition to the quiescent state 202.

Figure 2B:
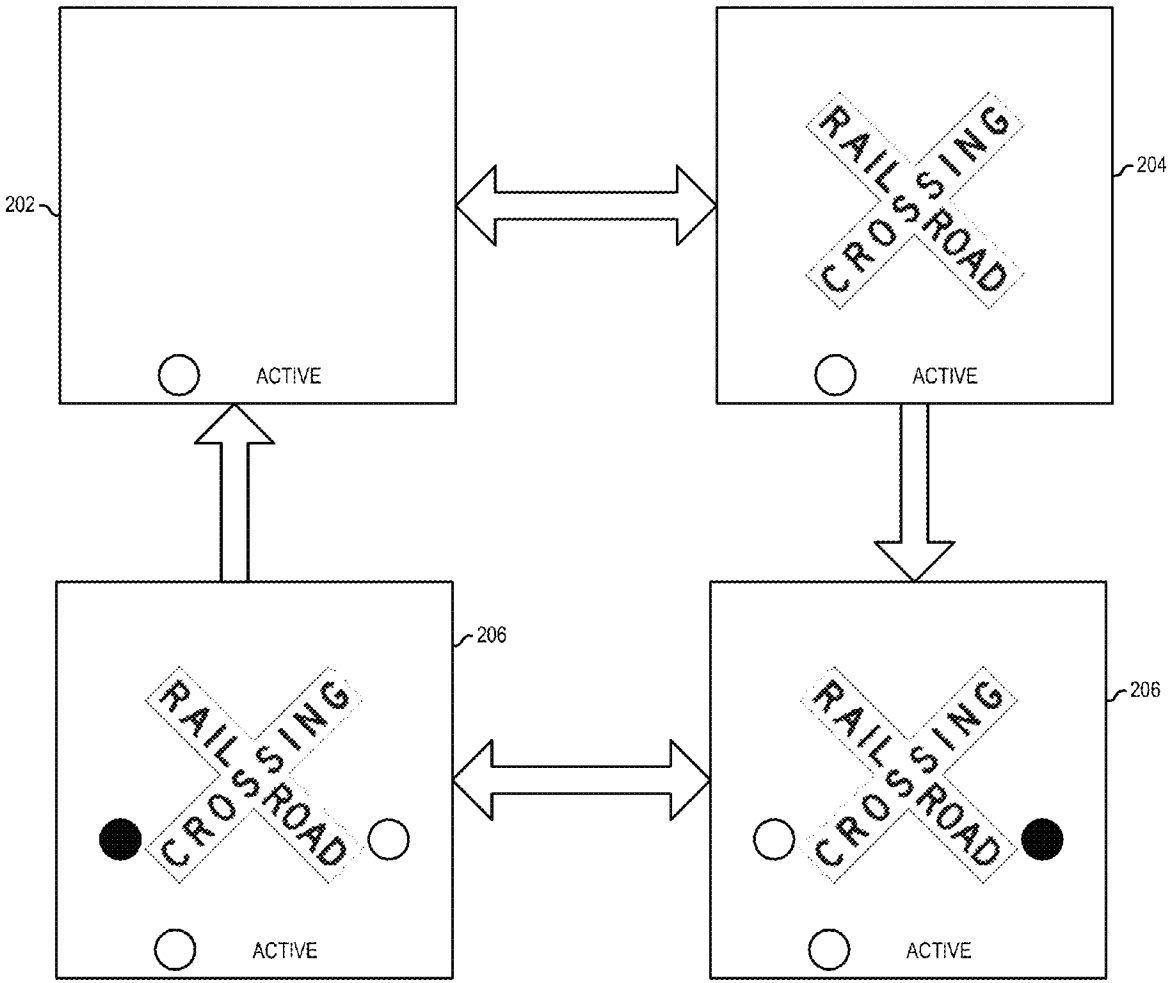

An additional state diagram of a proximity alert and train-on-approach notification system 100 is shown in FIG. 2B. As shown in FIG. 2B, when the receiver 102 is in the quiescent state 202, the receiver 102 continually flashes an "ACTIVE" notification on the display 142, e.g. an LED, to inform a driver that the receiver 102 is operating.

If the receiver 102 is within range of a base station 104 and transitions to the proximity state 204, the receiver 102 displays a railroad crossing sign or a similar notification on the display 142 to signify that the driver is approaching a railroad crossing. In addition, while in the proximity state 204, the receiver 102 may provide an audible notification to further warn a driver.

If the receiver 102 is within range of a base station 104 that has a train on approach, the receiver 102 transitions from the proximity state 204 to the train-on-approach state 206 and displays the railroad crossing sign in addition to alternately flashing a notification on the display 142. As shown in FIG. 2B, while in the train-on-approach state 206, the display 142 will simulate alternating flashing lights on a railroad crossing sign. The flashing lights may be red or another color. In addition, while in the train-on-approach state 206, the receiver 102 may provide an audible notification to further warn a driver, such as a simulation of railroad crossing bells, a train horn, etc. Alternate indicators may be used to display the various states, such as a first visual and/or audible indicator for the proximity state 204, a second visual and/or audible indicator for the train-on-approach state 206, and a third optional visual and/or audible indicator for the quiescent state 202.

Figure 3A:
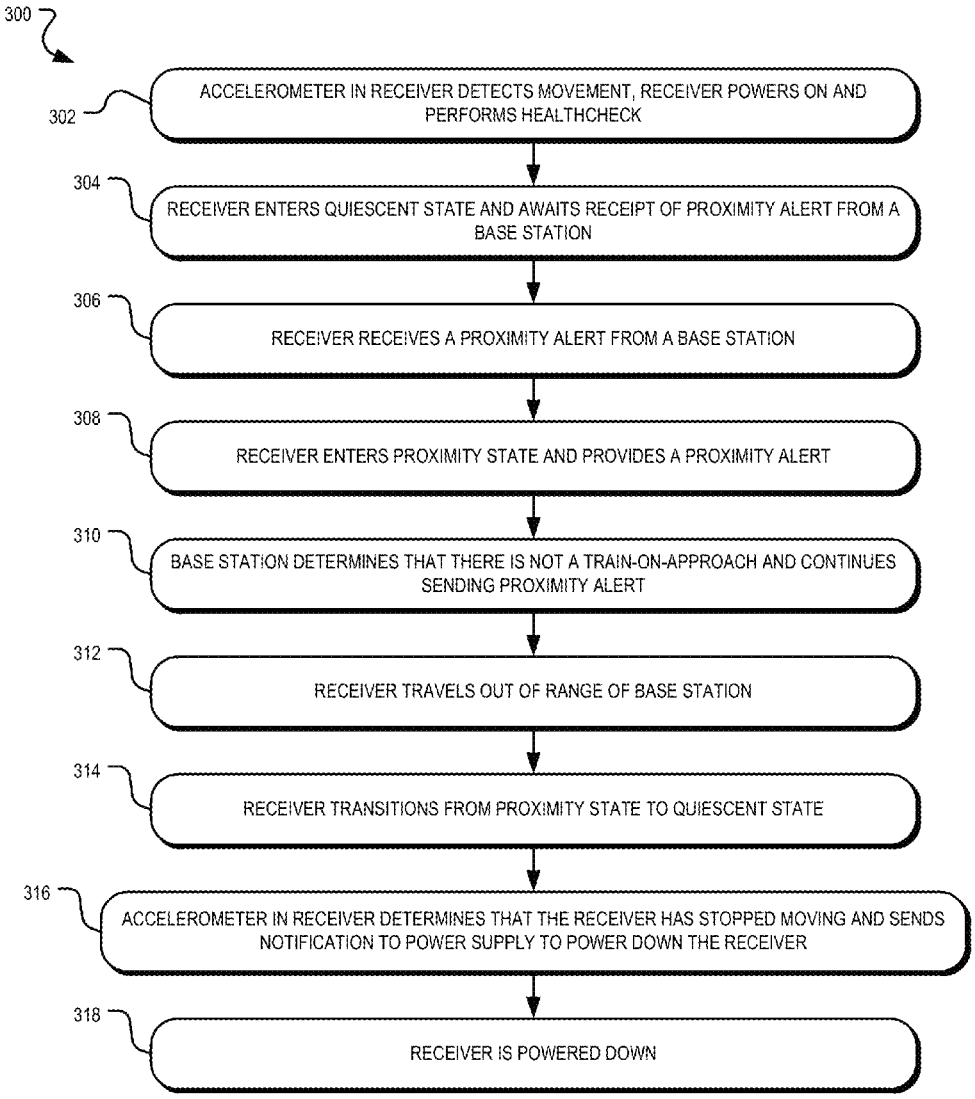
FIG. 3A illustrates a flowchart of a process of a receiver receiving a proximity alert from a base station according to an example embodiment.

FIG. 3A illustrates a flowchart of a process 300 of the receiver 102 receiving a proximity alert from the base station 104 according to an example embodiment. The process 300 shown in FIG. 3A begins in step 302. In step 302, the accelerometer 126 in the receiver 102 detects movement that indicates that the receiver 102 is in motion. The accelerometer 126 sends a notification to the power supply 130 to provide electrical power to the receiver 102, and the receiver 102 powers on. After powering on, the receiver 102 optionally performs a HealthCheck.

Next, in step 304, the receiver 102 enters the quiescent state 202 and awaits receipt of a proximity alert from a base station 104. While in the quiescent state 202, the receiver 102 will periodically provide a notification, visually and/or audibly, that the receiver 102 is powered on, engaging in low power listening, and awaiting receipt of a proximity alert from a base station 104. In step 306, the receiver 102 comes into range of a network 106 associated with a base station 104. According to an example embodiment, the network 106 associated with the base station extends approximately 0.1 miles from the base station 104. In another example, the network 106 associated with the base station extends 0.5 miles or greater from the base station 104.

The receiver 102 receives a proximity alert that is being broadcast from the base station 104 and optionally performs a checksum algorithm on the message associated with the proximity alert to confirm that the proximity alert is valid. If the message associated with the proximity alert is valid, then in step 308, the receiver 102 enters the proximity state 204 and provides a proximity alert. The proximity alert is provided by the receiver 102 visually and/or audibly.

In step 310, the base station 104 determines that there is not a train-on-approach to the associated railroad crossing and continues to broadcast the proximity alert. The base station 104 determines that no train-on-approach message was received from at least one of a PTC database 176 sending a PTC signal 188, a railroad dispatch center 174 sending a PTC signal, a train 186 sending a PTC signal 190, and a crossing relay signal 192. In step 312, the receiver 102 travels outside of network 106 and/or out of broadcast range of the base station 104. In step 314, the receiver transitions from the proximity state 204 back to the quiescent state 202.

In step 316, the accelerometer in the receiver 102 detects that the vehicle is no longer moving, e.g., the receiver 102 is located in a vehicle that has been parked. After a predetermined period of time, e.g., five minutes or a selectable range of 1-10 minutes, the accelerometer 126 will send a notification to the power supply 130 to discontinue providing electrical power and power down the receiver 102. In step 318, the receiver 102 is powered down.

Figure 3B:
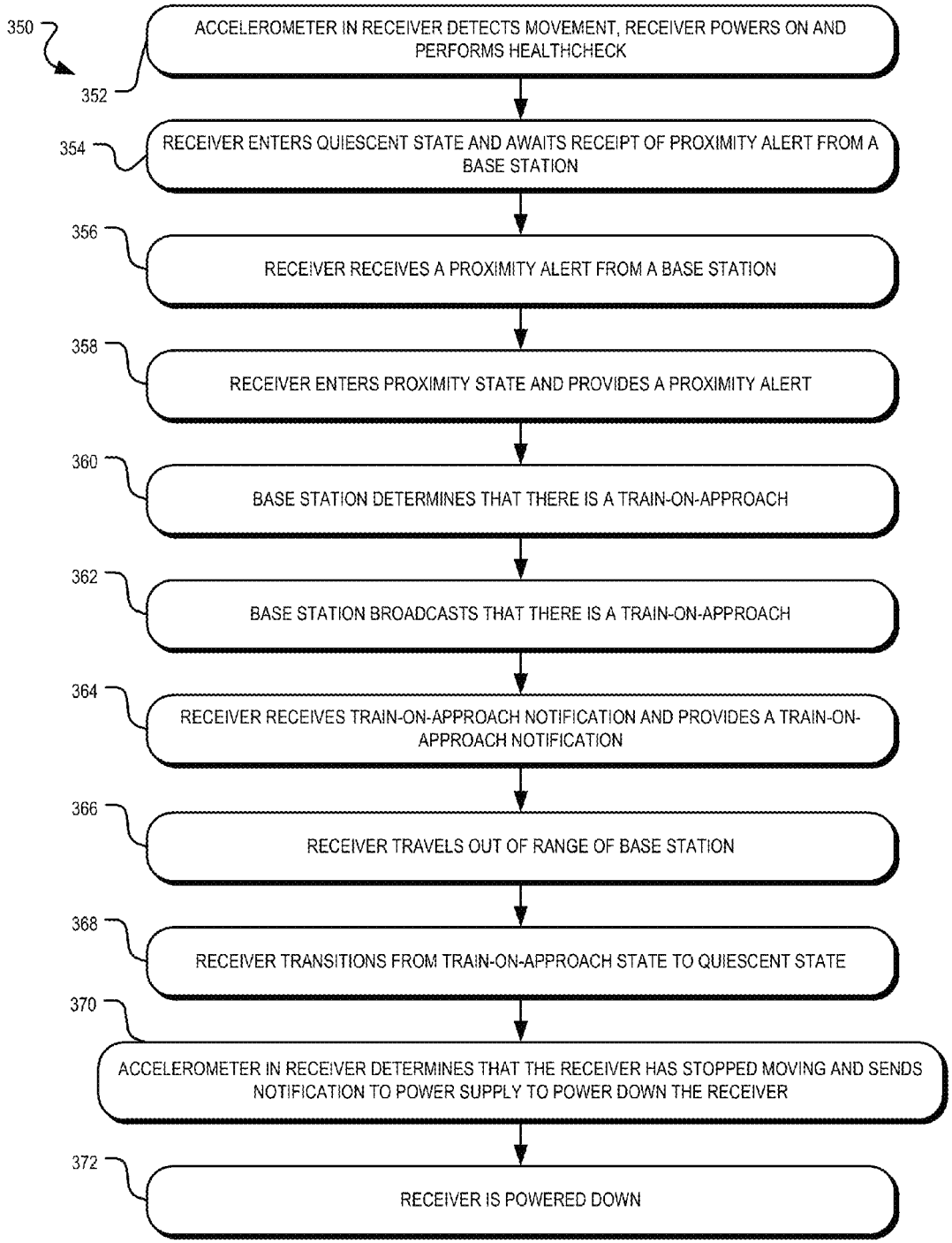
FIG. 3B illustrates a flowchart of a process of a receiver receiving a proximity alert and a train-on-approach notification from a base station according to an example embodiment.

FIG. 3B illustrates a flowchart of a process 350 of the receiver 102 receiving a proximity alert and a train-on-approach notification from the base station 104 according to an example embodiment. The process 350 shown in FIG. 3B begins in step 352. In step 352, the accelerometer 126 in the receiver 102 detects movement that indicates that a vehicle is in motion. The accelerometer 126 sends a notification to the power supply 130 to supply electrical power to the receiver 102 and the receiver 102 powers on. After powering on, the receiver 102 optionally performs a HealthCheck.

Next, in step 354, the receiver 102 enters the quiescent state 202, begins low power listening, and awaits receipt of a proximity alert from a base station 104. While in the quiescent state 202, the receiver 102 will periodically provide a notification, visually and/or audibly, that the receiver 102 is powered on and awaiting receipt of a proximity alert from a base station 104. In step 356, the receiver 102 comes into range of a network associated with a base station 104. According to an example embodiment, the network 106 associated with the base station extends approximately 0.1 miles from the base station 104. In another example, the network 106 associated with the base station extends 0.5 miles or greater from the base station 104. The receiver 102 receives a proximity alert that is being broadcast from the base station 104 and optionally performs a checksum algorithm on a message associated with the proximity alert to confirm that the proximity alert is valid. If the message associated with the proximity alert is determined to be valid, in step 358, the receiver 102 enters the proximity state 204 and provides a proximity alert. The proximity alert is provided visually and/or audibly.

In step 360, the base station 104 receives a train-on-approach message and determines that there is a train-on-approach to the associated railroad crossing. A train-on-approach message can be sent to the base station 104 from at least one of a PTC database 176 sending a PTC signal 188, a railroad dispatch center 174 sending a PTC signal, a train 186 sending a PTC signal 190, and a crossing relay signal 192. In step 362, the base station 102 modifies a broadcast from a proximity alert to a train-on-approach notification and broadcasts that there is a train-on-approach to the associated railroad crossing. In step 364, the receiver 102 receives the train-on-approach notification from the base station 104, enters the train-on-approach state 206, and provides a heightened train-on-approach notification. The train-on-approach notification is provided by the receiver 102 visually and/or audibly.

In step 366, the receiver 102 travels out of range of the base station 104. In step 368, the receiver 102 transitions from the train-on-approach state 206 back to the quiescent state 202. In step 370, the accelerometer 126 in the receiver 102 detects that the vehicle is no longer moving. After a predetermined period of time, e.g. five minutes or a selectable range of 1-10 minutes, the accelerometer 126 will send a notification to the power supply 130 to discontinue providing electrical power and power down the receiver 102. In step 372, the receiver 102 is powered down.

Figure 4:
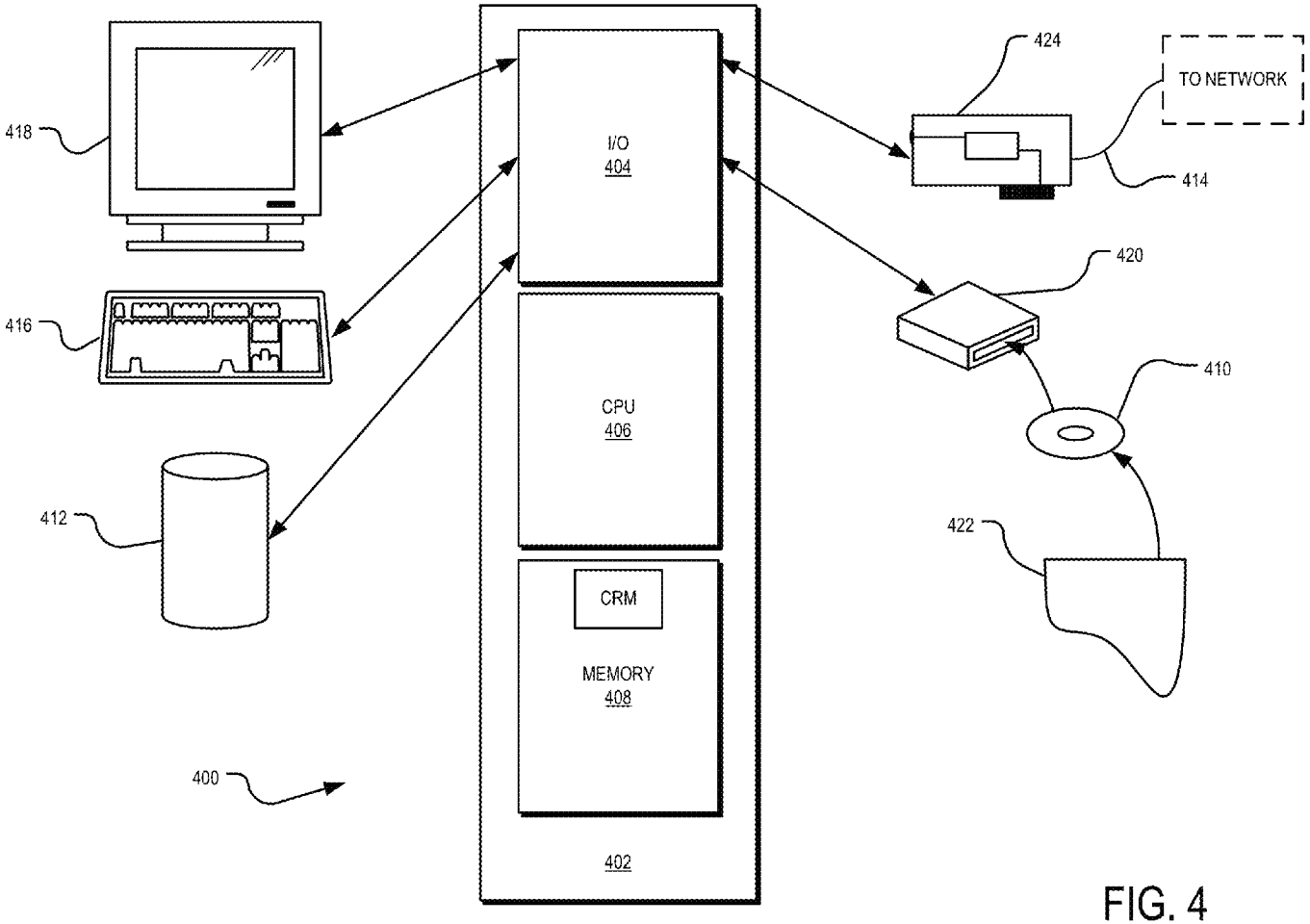
FIG. 4 illustrates a block diagram of an example computer device for use with the example embodiments.

FIG. 4 illustrates an example computing system 400 that may implement various systems, such as receiver 102, base station 104, PTC database 116, PTC equipment 118, and railroad dispatch center 120, and methods discussed herein, such as process 300 and process 350. A general purpose computer system 400 is capable of executing a computer program product to execute a computer process. Data and program files may be input to the computer system 400, which reads the files and executes the programs therein. Some of the elements of a general purpose computer system 400 are shown in FIG. 4 wherein a processor 402 is shown having an input/output (I/O) section 404, a central processing unit (CPU) 406, and a memory section 408. There may be one or more processors 402, such that the processor 402 of the computer system 400 comprises a single central-processing unit 406, or a plurality of processing units, commonly referred to as a parallel processing environment. The computer system 400 may be a conventional computer, a server, a distributed computer, or any other type of computer, such as one or more external computers made available via a cloud computing architecture. The presently described technology is optionally implemented in software devices loaded in memory 408, stored on a configured DVD/CD-ROM 410 or storage unit 412, and/or communicated via a wired or wireless network link 414, thereby transforming the computer system 400 in FIG. 4 to a special purpose machine for implementing the described operations.

The memory section 408 may be volatile media, nonvolatile media, removable media, non-removable media, and/or other media or mediums that can be accessed by a general purpose or special purpose computing device. For example, the memory section 408 may include non-transitory computer storage media and communication media. Non-transitory computer storage media further may include volatile, nonvolatile, removable, and/or non-removable media implemented in a method or technology for the storage (and retrieval) of information, such as computer/machine-readable/executable instructions, data and data structures, engines, program modules, and/or other data. Communication media may, for example, embody computer/machine-readable/executable, data structures, program modules, algorithms, and/or other data. The communication media may also include an information delivery technology. The communication media may include wired and/or wireless connections and technologies and be used to transmit and/or receive wired and/or wireless communications.

The I/O section 404 is connected to one or more user-interface devices (e.g., a keyboard 416 and a display unit 418), a disc storage unit 412, and a disc drive unit 420. Generally, the disc drive unit 420 is a DVD/CD-ROM drive unit capable of reading the DVD/CD-ROM medium 410, which typically contains programs and data 422. Computer program products containing mechanisms to effectuate the systems and methods in accordance with the presently described technology may reside in the memory section 404, on a disc storage unit 412, on the DVD/CD-ROM medium 410 of the computer system 400, or on external storage devices made available via a cloud computing architecture with such computer program products, including one or more database management products, web server products, application server products, and/or other additional software components. Alternatively, a disc drive unit 420 may be replaced or supplemented by a floppy drive unit, a tape drive unit, or other storage medium drive unit. The network adapter 424 is capable of connecting the computer system 400 to a network via the network link 414, through which the computer system can receive instructions and data. Examples of such systems include personal computers, Intel or PowerPC-based computing systems, AMD-based computing systems and other systems running a Windows-based, a UNIX-based, or other operating system. It should be understood that computing systems may also embody devices such as Personal Digital Assistants (PDAs), mobile phones, tablets or slates, multimedia consoles, gaming consoles, set top boxes, etc.

When used in a LAN-networking environment, the computer system 400 is connected (by wired connection or wirelessly) to a local network through the network interface or adapter 424, which is one type of communications device. When used in a WAN-networking environment, the computer system 400 typically includes a modem, a network adapter, or any other type of communications device for establishing communications over the wide area network. In a networked environment, program modules depicted relative to the computer system 400 or portions thereof, may be stored in a remote memory storage device. It is appreciated that the network connections shown are examples of communications devices for and other means of establishing a communications link between the computers may be used.

In an example implementation, source code executed by the receiver 102 and base station 104, a plurality of internal and external databases, source databases, and/or cached data on servers are stored in memory of the receiver 102 and the base station 104, the memory 408 or other storage systems, such as the disk storage unit 412 or the DVD/CD-ROM medium 410, and/or other external storage devices made available and accessible via a network architecture. The source code executed by the receiver 102 and base station 104 may be embodied by instructions stored on such storage systems and executed by the processor 402.

Some or all of the operations described herein may be performed by the processor 402. Further, local computing systems, remote data sources and/or services, and other associated logic represent firmware, hardware, and/or software configured to control operations of the system 100 and/or other components. Such services may be implemented using a general purpose computer and specialized software (such as a server executing service software), a special purpose computing system and specialized software (such as a mobile device or network appliance executing service software), or other computing configurations. In addition, one or more functionalities disclosed herein may be generated by the processor 402 and a user may interact with a Graphical User Interface (GUI) using one or more user-interface devices (e.g., the keyboard 416, the display unit 418, and the user devices 404) with some of the data in use directly coming from online sources and data stores. The system set forth in FIG. 4 is but one possible example of a computer system that may employ or be configured in accordance with aspects of the present disclosure.

In the present disclosure, the methods disclosed may be implemented as sets of instructions or software readable by a device. Further, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a machine-readable medium having stored thereon instructions, which may be used to program a computer system (or other electronic devices) to perform a process according to the present disclosure. A machine-readable medium includes any mechanism for storing information in a form (e.g., software, processing application) readable by a machine (e.g., a computer). The machine-readable medium may include, but is not limited to, magnetic storage medium (e.g., floppy diskette), optical storage medium (e.g., CD-ROM); magneto-optical storage medium, read only memory (ROM); random access memory (RAM); erasable programmable memory (e.g., EPROM and EEPROM); flash memory; or other types of medium suitable for storing electronic instructions.

The description above includes example systems, methods, techniques, instruction sequences, and/or computer program products that embody techniques of the present disclosure. However, it is understood that the described disclosure may be practiced without these specific details.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A system for notifying a driver about a proximate railroad crossing, the system comprising:

a processor-based transmitter associated with the railroad crossing and programmed to wirelessly transmit a crossing proximity alert that is not indicative of an approaching train, recognize that a train is on approach, and wirelessly transmit a train-on-approach notification that is indicative of the approaching train; and a processor-based receiver programmed to wirelessly receive the proximity alert and the train-on-approach notification and to generate at least one of a visual and audible indication in response to at least one of the proximity alert and the train-on-approach notification.

2. The system of claim 1, wherein the transmitter is programmed to receive another train-on-approach notification is-sent to the transmitter using a unique identifier, the unique identifier identifying the transmitter, the other train-on-approach notification indicating that there is a train passing through the railroad crossing or on approach to the railroad crossing.

3. The system of claim 2, wherein the transmitter is programmed to receive the other train-on-approach notification from at least one of a crossing relay activated by a train-on-approach to the transmitter in communication with the transmitter, a positive train control (PTC) database connected to the transmitter via a network and activated by a train-on-approach to the transmitter, a railroad dispatch center connected to the transmitter via a network and activated by a train-on-approach to the transmitter, and a PTC transmitter onboard a train-on-approach connected to the transmitter via a network.

4. The system of claim 3, wherein the transmitter is programmed to receive the other train-on-approach notification from the PTC transmitter onboard the train-on-approach which sends the other train-on-approach notification wirelessly to the transmitter when at least one of the following occurs: the train-on-approach connects to a wireless network associated with the transmitter; and the train-on-approach is a predetermined distance from the transmitter.

5. The system of claim 3, wherein the transmitter is programmed to receive the other train-on-approach notification from the railroad dispatch center as a product of:

the railroad dispatch center having a geo-location processor, such that when a train-on-approach to the transmitter sends a first latitude, a first longitude, and a current speed to the geo-location processor in the railroad dispatch center, the geo-location processor compares the first latitude and the first longitude with a second latitude and a second longitude associated with the unique identifier to determine a distance between the train-on-approach and the transmitter, the geo-location processor determining a time until the train-on-approach arrives at the transmitter using the current speed and the distance between the train-on-approach and the transmitter, and the geo-location processor in the railroad dispatch center causing the PTC database to forward the other train-on-approach notification to the transmitter.

6. The system of claim 1, wherein the receiver is programmed to enter into a waiting state when the receiver powers on.

7. The system of claim 6, wherein the receiver is programmed to perform a check to determine an available battery level when the receiver enters the waiting state.

8. The system of claim 7, wherein the receiver is programmed to periodically indicate that the receiver is powered on and waiting to receive the proximity alert.

9. The system of claim 1, wherein the receiver is programmed to receive the proximity alert when the receiver comes within a predetermined distance of the transmitter and to enter into a proximity state in response thereto.

10. The system of claim 9, wherein the receiver is programmed to transition into a waiting state when the receiver moves outside of the predetermined distance of the transmitter.

11. The system of claim 9, wherein the receiver is programmed to receive the train-on-approach notification and transition into a train-on-approach state in response thereto.

12. The system of claim 11, wherein the receiver is programmed to transition into a waiting state when the receiver moves outside of the predetermined distance of the transmitter.

13. The system of claim 1, wherein the receiver further comprises a power supply having at least one of a coin-cell battery, a solar cell, and an inertial energy harvester.

14. The system of claim 1, wherein the receiver further comprises an accelerometer.

15. The system of claim 14, wherein the receiver is programmed to receive power from a power supply when the receiver detects an acceleration greater than a predetermined level using the accelerometer.

16. The system of claim 15, wherein the receiver is programmed to stop receiving power from the power supply when the receiver detects an acceleration less than the predetermined level for a predetermined period of time using the accelerometer.

17. The system of claim 1, wherein the receiver further comprises a display unit, the receiver programmed to display information regarding at least one of the proximity alert and the train-on-approach notification via the display unit.

18. The system of claim 1, wherein the transmitter comprises an antenna and is programmed to wirelessly transmit the proximity alert and the train-on-approach notification in a 2.4 GHz radio spectrum using the antenna.

19. The system of claim 1, wherein the receiver comprises an antenna and is programmed to wirelessly receive the proximity alert and the train-on-approach notification in a 2.4 GHz radio spectrum using the antenna.

20. The system of claim 2, wherein the transmitter further comprises at least one of a positive train control (PTC) wayside message server, a cellular radio, and a modem to receive the other train-on-approach notification.

21. The system of claim 1, wherein the transmitter is associated with a railroad crossing that is one of an active electrified railroad crossing and a passive non-electrified railroad crossing.

22. The system of claim 1, wherein the receiver is programmed to wirelessly transmit at least one of another proximity alert and another train-on-approach notification to another receiver.

23. The system of claim 1, wherein the transmitter is programmed to wirelessly transmit the proximity alert with a first checksum and the train-on-approach notification with a second checksum, the receiver being programmed to wirelessly receive the proximity alert with the first checksum and the train-on-approach notification with the second checksum, and the receiver being further programmed to validate the proximity alert using the first checksum and the train-on-approach notification using the second checksum.

24. The system of claim 1, wherein the receiver comprises one of a fastener that is to be mounted to a windshield of the driver's vehicle, a fastener that is to be mounted to a dashboard of the driver's vehicle, and a fastener that is to be mounted to a rearview mirror assembly of the driver's vehicle.

25. The system of claim 1, wherein the transmitter is operable to broadcast the proximity alert and the train-on-approach notification at a frequency of 5.9 GHz.

26. The system of claim 1, wherein the transmitter and receiver are operable to conduct a Dedicated Short Range Communications (DSRC) communication of the crossing proximity alert and the train-on-approach notification.

27. The system of claim 26, wherein the receiver is onboard a vehicle.

28. A system for notifying a driver about a proximate railroad crossing, the system comprising a processor-based receiver programmed to:

wirelessly receive a crossing proximity alert encoded in a first message from a transmitter and not indicative of an approaching train;

wirelessly receive a train-on-approach notification encoded in a second message from the transmitter and indicative of an approaching train;

display information in response to receiving the proximity alert and the train-on-approach notification; and provide audible information in response to receiving the proximity alert and the train-on-approach notification.

29. The system of claim 28, wherein the receiver is further programmed to:

detect an acceleration greater than a predetermined level of acceleration using an accelerometer and activate a motion switch to derive electrical power from a power supply and perform a check to determine a battery level;

perform low power radio listening to receive the proximity alert encoded in the first message;

perform low power radio listening to receive the train-on-approach notification encoded in the second message;

detect an acceleration that is less than the level of acceleration for a predetermined period of time using the accelerometer; and send a notification to deactivate the motion switch and stop deriving electrical power from the power supply in response to the acceleration that is less than the level of acceleration for the predetermined period of time.

30. The system of claim 28, wherein the receiver is operable to receive the crossing proximity alert and the train-on-approach notification at a frequency of 5.9 GHz.

31. The system of claim 28, wherein the receiver is operable to conduct a Dedicated Short Range Communications (DSRC) communication with a transmitter.

32. The system of claim 28, wherein the receiver is a vehicle-borne receiver.

33. A system for notifying a driver about a proximate railroad crossing, the system comprising a processor-based transmitter programmed to:

receive electrical power from a power supply having at least one of a battery, a solar cell, and a commercial power station;

wirelessly transmit a 2.4 GHz radio spectrum, a crossing proximity alert that is not indicative of an approaching train;

receive a first train-on-approach notification from at least one of a railroad crossing relay, a positive train control (PTC) database, a railroad dispatch center, and a PTC transmitter onboard a train-on-approach; and wirelessly transmit in a 2.4 GHz radio spectrum and in response to receiving the first train-on-approach notification, a second train-on-approach notification indicative of the approaching train.

34. A system for notifying a driver about a proximate railroad crossing, the system comprising:

processor-based transmitter programmed to transmit at least one of a first crossing proximity alert and a first train-on-approach notification, wherein the first proximity alert is not indicative of an approaching train and wherein the first train-on-approach notification is indicative of an approaching train; and a processor-based receiver programmed to receive the at least one of the first proximity alert and the first train-on-approach notification and to generate at least one of a second proximity alert and a second train-on-approach notification.

35. The system of claim 34, wherein the receiver is programmed to produce a proximity warning as the second proximity alert and a train-on-approach warning as the second train-on-approach notification.

36. The system of claim 35, wherein the second proximity warning comprises a visual representation of at least one of a railroad crossing and a railroad crossing sign.

37. The system of claim 35, wherein the second train-on-approach warning comprises a visual representation of a railroad crossing sign with alternating periodic flashing red indicators.

38. The system of claim 35, wherein the second proximity warning comprises an audible representation of railroad crossing bells.

39. The system of claim 35, wherein the second train-on-approach warning comprises an audible representation of a train horn.

40. The system of claim 34 wherein the receiver and the transmitter are operable at a frequency of 2.4 GHz or 5.9 GHz.

41. The system of claim 34, wherein the transmitter and receiver are operable to conduct a Dedicated Short Range Communications (DSRC) communication of the first crossing proximity alert and the first train-on-approach notification.

42. The system of claim 34, wherein the receiver is carried on a vehicle.

43. A method performed by a processor-based receiver for notifying a driver about a proximate railroad crossing, the method comprising:

entering into a waiting state;

receiving a crossing proximity alert from a transmitter, wherein the proximity alert is not indicative of an approaching train;

entering into a proximity state from the waiting state in response to the proximity alert received from the transmitter;

providing at least one of visual and audible information in response to entering the proximity state;

receiving, a train-on-approach notification from the transmitter, wherein the train-on-approach notification is indicative of an approaching train;

entering into a train-on-approach state from the proximity state in response to the train-on-approach notification received from the transmitter; and providing at least one of visual and audible information in response to entering the train-on-approach state.

44. The method of claim 43, further comprising:

detecting a level of acceleration;

receiving electrical power from a power supply in response to detecting the level of acceleration;

detecting an acceleration that is less than the level of acceleration for a predetermined period of time; and stopping the receipt of electrical power from the power supply in response to the acceleration that is less than the level of acceleration for the predetermined period of time.

45. The method of claim 43, wherein the processor-based receiver is operable to receive the crossing proximity alert and the train-on-approach notification at a frequency of 5.9 GHz.

46. The method of claim 43, wherein the processor-based receiver is operable to conduct a Dedicated Short Range Communications (DSRC) communication with a transmitter.

47. The method of claim 43, wherein the processor-based receiver is a vehicle-borne receiver.

48. A method performed by a processor-based receiver for notifying a driver about a proximate railroad crossing, the method comprising:

receiving a level of acceleration;

receiving electrical power in response to the level of acceleration;

entering into a waiting state;

receiving a crossing proximity alert from a transmitter, wherein the proximity alert is not indicative of an approaching train;

entering into a proximity state from the waiting state in response to the proximity alert received from the transmitter;

outputting at least one of visual and audible information in response to entering into the proximity state;

receiving an acceleration that is less than the level of acceleration for a predetermined period of time; and stopping receipt of electrical power from a power supply in response to receiving an acceleration that is less than the level of acceleration for a predetermined period of time.

49. The method of claim 48, wherein the processor-based receiver is operable to receive the crossing proximity alert and the train-on-approach notification at a frequency of 5.9 GHz.

50. The method of claim 48, wherein the processor-based receiver is operable to conduct a Dedicated Short Range Communications (DSRC) communication with a transmitter.

51. The method of claim 48, wherein the processor-based receiver is a vehicle-borne receiver.

52. A method performed by a processor-based system having a transmitter and a receiver for notifying a driver about a proximate railroad crossing, the method comprising:

wirelessly transmitting from the transmitter, a crossing proximity alert that is not indicative of an approaching train, determining that a train is on approach, and wirelessly transmitting a train-on-approach notification that is indicative of the approaching train; and wirelessly receiving at the receiver, the proximity alert and the train-on-approach notification, and providing at least one of a visual and audible indication in response to at least one of the proximity alert and the train-on-approach notification.

53. The method of claim 52, further comprising receiving, at the transmitter, another train-on-approach notification indicating that there is a train passing through the railroad crossing or on approach to the railroad crossing.

54. The method of claim 53, further comprising receiving at the transmitter, the other train-on-approach notification from at least one of a crossing relay activated by a train-on-approach to the railroad crossing in communication with the at least one first processor, a positive train control (PTC) database connected to the at least one first processor via a network and activated by a train-on-approach to the railroad crossing, a railroad dispatch center connected to the at least one first processor via a network and activated by a train-on-approach to the railroad crossing, and a PTC transmitter onboard a train-on-approach connected to the at least one first processor via a network.

55. The method of claim 54, further comprising wirelessly receiving at the transmitter, from the PTC transmitter onboard the train-on-approach, the other train-on-approach notification when at least one of the following occurs: the train-on-approach connects to a wireless network and the train-on-approach is a predetermined distance from the railroad crossing.

56. The method of claim 54, further comprising receiving the other train-on-approach notification at the transmitter from the railroad dispatch center, wherein the other train-on-approach notification is a product of:

receiving a first latitude, a first longitude, and a current speed associated with the train-on-approach in a geo-location processor in the railroad dispatch center;

comparing the first latitude and the first longitude with a second latitude and a second longitude associated with the railroad crossing to determine a distance between the train-on-approach and the railroad crossing; and determining a time until the train-on-approach arrives at the railroad crossing using the current speed and the distance between the train-on-approach and the railroad crossing.

57. The method of claim 53 wherein the processor-based receiver and the processor-based transmitter are operable to communicate at a frequency of 5.9 GHz.

58. The method of claim 53 wherein the processor-based receiver and the processor-based transmitter operable to conduct a Dedicated Short Range Communications (DSRC) transmission of the crossing proximity alert and the train-on-approach notification.

59. The method of claim 53, wherein the processor-based receiver is a vehicle-borne receiver.

60. The method of claim 52, further comprising:

activating a power supply to provide power the receiver when an acceleration greater than a predetermined level is detected.

61. The method of claim 52, further comprising:

deactivating a power supply to discontinue providing power to the receiver when an acceleration less than a predetermined level is detected for a predetermined period of time.

* * * * *